US009328404B2

(12) United States Patent
Saw et al.

(10) Patent No.: US 9,328,404 B2
(45) Date of Patent: May 3, 2016

(54) IRON-BASED AMORPHOUS ALLOYS AND METHODS OF SYNTHESIZING IRON-BASED AMORPHOUS ALLOYS

(75) Inventors: Cheng Kiong Saw, Livermore, CA (US); William A. Bauer, Beavercreek, OH (US); Jor-Shan Choi, El Cerrito, CA (US); Dan Day, Danville, CA (US); Joseph C. Farmer, Tracy, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 792 days.

(21) Appl. No.: 12/426,769

(22) Filed: Apr. 20, 2009

(65) Prior Publication Data

US 2010/0263766 A1 Oct. 21, 2010

(51) Int. Cl.

| | |
|---|---|
| ***C22C 45/02*** | (2006.01) |
| ***C22C 33/00*** | (2006.01) |
| ***B22F 9/00*** | (2006.01) |
| ***C22C 45/00*** | (2006.01) |
| ***G21F 1/08*** | (2006.01) |
| *B22F 9/04* | (2006.01) |

(52) U.S. Cl.

CPC ..... *C22C 33/003* (2013.01); *B22F 9/005* (2013.01); *C22C 45/006* (2013.01); *C22C 45/02* (2013.01); *G21F 1/08* (2013.01); *B22F 9/002* (2013.01); *B22F 2009/041* (2013.01); *B22F 2009/043* (2013.01); *C22C 2200/02* (2013.01)

(58) Field of Classification Search

None

See application file for complete search history.

(56) References Cited

U.S. PATENT DOCUMENTS

| | | | | |
|---|---|---|---|---|
| 3,986,867 | A * | 10/1976 | Masumoto et al. | 148/403 |
| 4,439,236 | A * | 3/1984 | Ray | 148/334 |
| 6,010,580 | A | 1/2000 | Dandliker et al. | 148/403 |
| 6,284,061 | B1 * | 9/2001 | Inoue et al. | 148/304 |
| 7,052,561 | B2 * | 5/2006 | Lu et al. | 148/403 |
| 7,067,020 | B2 * | 6/2006 | Poon et al. | 148/403 |
| 2005/0263216 | A1 * | 12/2005 | Chin et al. | 148/304 |
| 2006/0130944 | A1 * | 6/2006 | Poon et al. | 148/561 |

OTHER PUBLICATIONS

Le Caer et al, "Mechanical alloying and high-energy ball-milling: technical simplicity and physical complexity for the synthesis of new materials: A sketch of mechanosyntehsis" Materiaux 2002; p. 1-5.

Jeng et al., "Formation and characterization of mechanically alloyed Ti—Cu—Ni—Sn bulk metallic glass composites" Intermetallics 14 (2006) 957-961 www.elsevier.com/locate/internet.

Lin et al., "Preparation and thermal stability of mechanically alloyed Ni—Zr—Ti—Y amorphous powders" Intermetallics 12 (2004). 1011-1017; www.elsevier.com/locate/intermet.

* cited by examiner

*Primary Examiner* — George Wyszomierski

(74) *Attorney, Agent, or Firm* — Zilka-Kotab

(57) ABSTRACT

A method according to one embodiment includes combining an amorphous iron-based alloy and at least one metal selected from a group consisting of molybdenum, chromium, tungsten, boron, gadolinium, nickel phosphorous, yttrium, and alloys thereof to form a mixture, wherein the at least one metal is present in the mixture from about 5 atomic percent (at %) to about 55 at %; and ball milling the mixture at least until an amorphous alloy of the iron-based alloy and the at least one metal is formed. Several amorphous iron-based metal alloys are also presented, including corrosion-resistant amorphous iron-based metal alloys and radiation-shielding amorphous iron-based metal alloys.

14 Claims, 6 Drawing Sheets

| Atomic Number | Element | Atomic Weight | Atomic % | Atomic % | Atomic % | Atomic % | Atomic % | Atomic % |
|---|---|---|---|---|---|---|---|---|
| | SAM40 | | SAM40 | SAM2X5 | SAM2X10 | SAM2X15 | SAM2X20 | SAM2X25 |
| 5 | Boron | 10.81 | 16.00 | 15.20 | 14.40 | 13.60 | 12.80 | 12.00 |
| 6 | Carbon | 12.011 | 4.00 | 3.80 | 3.60 | 3.40 | 3.20 | 3.00 |
| 14 | Silicon | 28.086 | 2.50 | 2.38 | 2.25 | 2.13 | 2.00 | 1.88 |
| 24 | Chromium | 51.996 | 19.00 | 18.05 | 17.10 | 16.15 | 15.20 | 14.25 |
| 25 | Manganese | 54.938 | 2.00 | 1.90 | 1.80 | 1.70 | 1.60 | 1.50 |
| 26 | Iron | 55.847 | 52.30 | 49.69 | 47.07 | 44.46 | 41.84 | 39.23 |
| 42 | Molybdenum | 95.94 | 2.50 | 7.38 | 12.25 | 17.12 | 22.00 | 26.87 |
| 74 | Tungsten | 183.85 | 1.70 | 1.62 | 1.53 | 1.45 | 1.36 | 1.28 |
| | Add to 2 grams | | | 0 | 0.209 | 0.442 | 0.706 | 1.0 |

Table 1: Listing of Atomic % Composition of SAM additions (the bottom row lists the amount of Mo (gm) to be added to a 2 gm matrix)

| Atomic Number | Element | Atomic Weight | Atomic % | Atomic % | Atomic % | Atomic % | Atomic % | Atomic % |
|---|---|---|---|---|---|---|---|---|
| | SAM40 | | SAM40 | SAM2X5 | SAM2X10 | SAM2X15 | SAM2X20 | SAM2X25 |
| 5 | Boron | 10.81 | 16.00 | 15.20 | 14.40 | 13.60 | 12.80 | 12.00 |
| 6 | Carbon | 12.011 | 4.00 | 3.80 | 3.60 | 3.40 | 3.20 | 3.00 |
| 14 | Silicon | 28.086 | 2.50 | 2.38 | 2.25 | 2.13 | 2.00 | 1.88 |
| 24 | Chromium | 51.996 | 19.00 | 18.05 | 17.10 | 16.15 | 15.20 | 14.25 |
| 25 | Manganese | 54.938 | 2.00 | 1.90 | 1.80 | 1.70 | 1.60 | 1.50 |
| 26 | Iron | 55.847 | 52.30 | 49.69 | 47.07 | 44.46 | 41.84 | 39.23 |
| 42 | Molybdenum | 95.94 | 2.50 | 7.38 | 12.25 | 17.12 | 22.00 | 26.87 |
| 74 | Tungsten | 183.85 | 1.70 | 1.62 | 1.53 | 1.45 | 1.36 | 1.28 |
| | Add to 2 grams | | | 0 | 0.209 | 0.442 | 0.706 | 1.0 |

Table 1: Listing of Atomic % Composition of SAM additions (the bottom row lists the amount of Mo (gm) to be added to a 2 gm matrix)

FIG. 5

| Element | 0% | 5% | 10% | 15% | 20% | 25% | 30% | 35% | 40% | 45% | 50% |
|---|---|---|---|---|---|---|---|---|---|---|---|
| Boron | 6.00 | 10.70 | 15.40 | 20.10 | 24.80 | 29.50 | 34.20 | 38.90 | 43.60 | 48.30 | 53.00 |
| Carbon | 15.00 | 14.25 | 13.50 | 12.75 | 12.00 | 11.25 | 10.50 | 9.75 | 9.00 | 8.25 | 7.50 |
| Chromium | 15.00 | 14.25 | 13.50 | 12.75 | 12.00 | 11.25 | 10.50 | 9.75 | 9.00 | 8.25 | 7.50 |
| Iron | 48.00 | 45.60 | 43.20 | 40.80 | 38.40 | 36.00 | 33.60 | 31.20 | 28.80 | 26.40 | 24.00 |
| Molybdenum | 14.00 | 13.30 | 12.60 | 11.90 | 11.20 | 10.50 | 9.80 | 9.10 | 8.40 | 7.70 | 7.00 |
| yttrium | 2.00 | 1.90 | 1.80 | 1.70 | 1.60 | 1.50 | 1.40 | 1.30 | 1.20 | 1.10 | 1.00 |
| add Boron | 0.000 | 0.0218 | 0.0459 | 0.0731 | 0.1035 | 0.1379 | 0.1772 | 0.2230 | 0.2760 | 0.3385 | 0.4136 |

Table 2: Atomic % of SAM1651 additions
(the bottom row lists the amount of Boron (gm) to be added to a 2 gm matrix)

FIG. 6

IRON-BASED AMORPHOUS ALLOYS AND METHODS OF SYNTHESIZING IRON-BASED AMORPHOUS ALLOYS

The United States Government has rights in this invention pursuant to Contract No. DE-AC52-07NA27344 between the United States Department of Energy and Lawrence Livermore National Security, LLC for the operation of Lawrence Livermore National Laboratory.

FIELD OF THE INVENTION

The present invention relates to iron-based alloys, and more particularly to iron-based amorphous alloys and methods of synthesis thereof.

BACKGROUND

Prevention of corrosion and methods and techniques of preventing corrosion are of great interest in many different industries and across many different fields. One such field is military applications, where corrosion resistant materials are applicable to the protection of military vehicles such as tanks, transports, helicopters, and airplanes. Perhaps more importantly, corrosion resistance is crucial in naval vessels and submarines, which come in contact with seawater. It is known that corrosion resistance can be improved by the used of structurally designed materials in the amorphous state where the atoms are arranged in a non-periodic fashion. In general, corrosion properties are attributed to both the atomic level and the microstructure level. At the atomic level, periodic defects exist which may create pathways for attack by ionic oxygen, nitrogen and/or hydrogen, which can travel through the crystal without significant obstruction. Grain boundaries and voids exist in crystalline materials, which are avenues for chemical attack into materials, substantially lowering their corrosion resistance. Crystalline materials often have anisotropic thermal expansion properties Thermal cycling can change microstructures, resulting in additional grain boundaries, dislocations, fractures and voids, which can initiate stress corrosion cracking.

In amorphous metals, also called metallic glasses when prepared from the molten state, atomic arrangements are essentially random. Changes in the precise atomic locations do not significantly affect material properties. In these structures, thermal expansion can be highly isotropic, and grain boundaries and other defects can be eliminated. These structural changes mitigate stress corrosion cracking, and increase corrosion resistance even though local short range chemical order does occur in amorphous materials. Amorphous materials can be elementally tailored to specific applications. Since amorphous materials do not have a sharply defined melting point, they can be heat-softened and mechanically shaped. Metallic glasses often exhibit extraordinary mechanical and thermal properties, magnetic behavior, and corrosion resistance.

High-iron amorphous metal alloys containing minor amounts of other elements have been designed for corrosion resistant applications. The atomization process used to prepare large quantities of iron-based amorphous alloys is compositionally limited due to restraints on the cooling rate necessary to achieve an amorphous state. This is called the critical cooling rate (CCR). When the CCR is not achieved, some crystallization occurs. Only a particular compositional range can effectively yield amorphous solids using conventional fabrication techniques.

Iron-based amorphous alloys have been produced by various techniques, for example, by atomization, melt spinning, and casting. The material mixtures are first melted and then quickly quenched to room temperature. The required CCRs are normally $10^4$ to $10^{11}$ Kelvin per second in order to achieve an amorphous structure. Atomized powders are thermal spray coated onto substrates using the high-velocity oxy-fuel (HVOF) process. Melt-spun ribbon samples of the same materials have also been prepared for testing purposes. Corrosion testing of iron-based amorphous ribbons suggests that corrosion resistance can be improved by increasing the alloy molybdenum content. However, it has heretofore been impossible to create an amorphous alloy with an appropriately high molybdenum content due to the high CCRs that are required.

Thus, current methods of amorphous alloy production are limited in what composition can be formed due to the process employed and the inherent requirement of high CCR. Therefore, it would be very beneficial to provide more flexibility in the composition of iron-based amorphous metal alloys by employing a more robust process of formation, resulting in more useful and previously unavailable coatings and/or structures with enhanced mechanical and/or thermal properties, magnetic behavior, and corrosion resistance.

SUMMARY

A method according to one embodiment includes combining an amorphous iron-based alloy and at least one metal selected from a group consisting of molybdenum, chromium, tungsten, boron, gadolinium, nickel phosphorous, yttrium, and alloys thereof to form a mixture, wherein the at least one metal is present in the mixture from about 5 atomic percent (at %) to about 55 at %; and ball milling the mixture at least until an amorphous alloy of the iron-based alloy and the at least one metal is formed.

An amorphous iron-based metal alloy according to one embodiment includes between about 10 atomic percent (at %) and about 50 at % iron; between about 0 at % and about 25 at % of a metal selected from a group consisting of manganese, carbon, silicon, zirconium, and titanium; and at least one of the following constituents:

- between about 15 at % and about 30 at % of at least one metal selected from a group consisting of molybdenum, tungsten, gadolinium, nickel phosphorous, yttrium, and alloys thereof;
- between about 20 at % and about 55 at % chromium; and
- between about 20 at % and about 55 at % boron.

A corrosion-resistant amorphous iron-based metal alloy according to another embodiment includes between about 10 atomic percent (at %) and about 50 at % iron; between about 15 at % and about 25 at % molybdenum; and between about 0 at % and about 25 at % of a metal selected from a group consisting of chromium, manganese, tungsten, carbon, boron, silicon, zirconium, and titanium.

A radiation-shielding amorphous iron-based metal alloy according to one embodiment includes between about 10 atomic percent (at %) and about 50 at % iron; between about 20 at % and about 55 at % boron; and between about 0 at % and about 25 at % of a metal selected from a group consisting of chromium, manganese, molybdenum, tungsten, carbon, silicon, zirconium, and titanium.

Other aspects, embodiments, and advantages of the present invention will become apparent from the following detailed description, which, when taken in conjunction with the drawings, illustrate by way of example the principles of the invention.

BRIEF DESCRIPTION OF THE DRAWINGS

FIG. 5 shows Table 1, the listing of atomic % composition of SAM additions.

FIG. 6 shows Table 2, the atomic % of SAM1651 additions.

DETAILED DESCRIPTION

Figure 1:
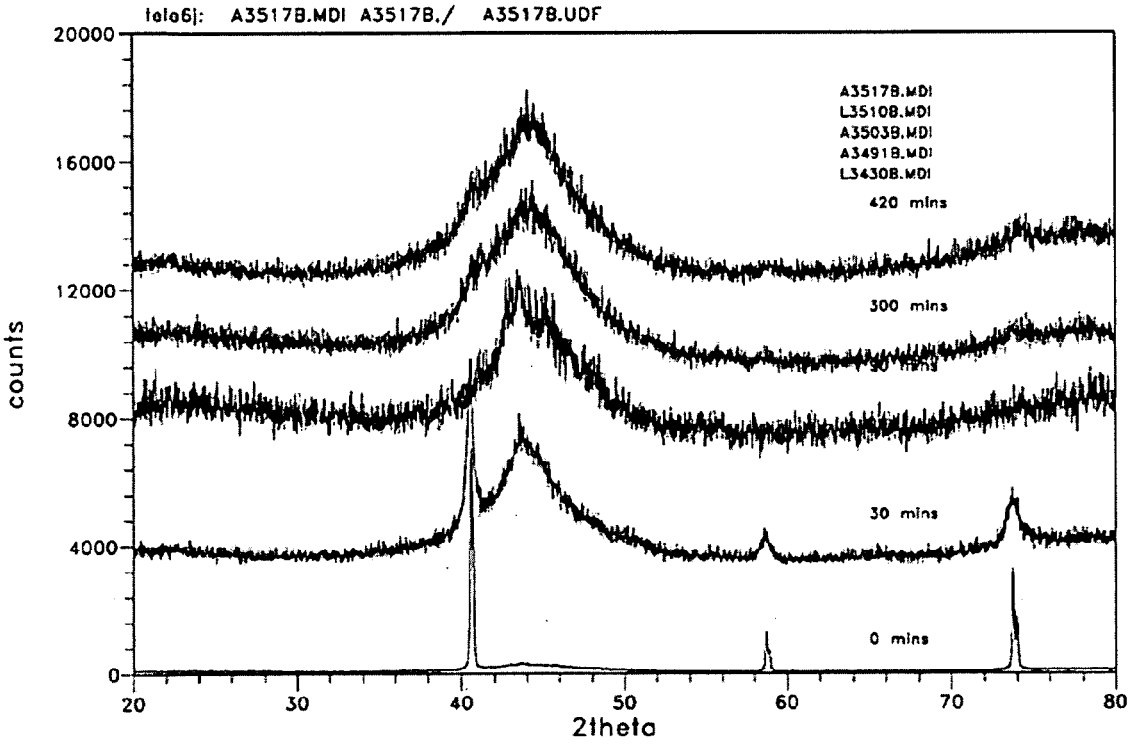
FIG. 1 shows an XRD spectra of SAM2X10 with increasing milling time.

The following description is made for the purpose of illustrating the general principles of the present invention and is not meant to limit the inventive concepts claimed herein. Further, particular feature described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

In one general embodiment, a method includes combining an amorphous iron-based alloy and at least one metal selected from a group consisting of molybdenum, chromium, tungsten, boron, gadolinium, nickel phosphorous, yttrium, and alloys thereof to form a mixture, wherein the at least one metal is present in the mixture from about 5 atomic percent (at %) to about 55 at %, and ball milling the mixture at least until an amorphous alloy of the iron-based alloy and the at least one metal is formed.

In another general embodiment, an amorphous iron-based metal alloy comprises between about 10 at % and about 50 at % iron, between about 0 at % and about 25 at % of a metal selected from a group consisting of manganese, carbon, silicon, zirconium, and titanium, and at least one of the following constituents: between about 15 at % and about 30 at % of at least one metal selected from a group consisting of molybdenum, tungsten, gadolinium, nickel phosphorous, yttrium, and alloys thereof, between about 20 at % and about 55 at % chromium, and between about 20 at % and about 55 at % boron.

In another general embodiment, a corrosion-resistant amorphous iron-based metal alloy comprises between about 10 at % and about 50 at % iron; between about 15 at % and about 25 at % molybdenum; and between about 0 at % and about 25 at % of a metal selected from a group consisting of chromium, manganese, tungsten, carbon, boron, silicon, zirconium, and titanium.

In another general embodiment, a radiation-shielding amorphous iron-based metal alloy comprises between about 10 at % and about 50 at % iron; between about 20 at % and about 55 at % boron; and between about 0 at % and about 25 at % of a metal selected from a group consisting of chromium, manganese, molybdenum, tungsten, carbon, silicon, zirconium, and titanium.

According to some embodiments, mechanical alloying techniques may be used to change the composition of iron-based amorphous alloys. This change is often very useful in many applications, because not only is there a need for the material to be amorphous; but also, the material may be tuned to enhance certain critical properties, for example corrosion resistance, neutron absorbance, hardness, etc.

Iron-based alloys may include many elements, for example, iron (Fe), chromium (Cr), manganese (Mn), molybdenum (Mo), tungsten (W), carbon (C), silicon (Si), zirconium (Zr), titanium (Ti), and/or others. Other elements may be added at many occasions in the processing, possibly as a processing aid. In principle, using the techniques presented herein, the amorphous structure for a specific material may be produced. However, not all the amorphous materials are alike and not all the iron-based amorphous alloys are alike. The composition for each element may be a function of the desired defined properties. Similarly, the resultant material properties are in part controlled by the atomic compositions. These materials are of considerable interest because of the improvement in corrosion resistance for several reasons. One reason might be the lack of atomic ordering resulting in the absent of grain boundaries, which often are the weakest regions of the material. Possible applications for these materials are in areas of coatings to protect surfaces, pipes, tanks, components, vessels, etc.

SAM2X5 which has the composition of $Fe_{49.7}Cr_{17.7}Mn_{1.9}Mo_{7.4}W_{1.6}C_{3.8}Si_{2.4}$ and SAM1651 with the composition of $Fe_{49.1}Cr_{14.6}Mo_{13.9}B_{5.9}C_{14.0}Si_{0.3}Y_{1.9}Ni_{0.2}$, have been studied and the results of the studies have been included in the section called Experimental Results, below. Prior art materials which feature amorphous characteristics have been prepared by atomization and melt spinning. In these cases, the materials are initially physically mixed, thermally excited by heating to a completely molten (liquid) state, and quickly cooled down. It has been reported that the required CCR (critical cooling rate) has to be in the range of $10^4$-$10^{6o}$ K/sec, otherwise the amorphous structure will not be formed. Without the proper cooling rate, there is a tendency for the material to crystallize and hence the amorphous nature and the amorphous properties of the materials will not be achieved. At times, small amounts of other compounds, for example Yttrium, may be added to lower the CCR. The range of iron-based amorphous materials that can be produced by these methods are clearly defined by CCR and the ability of the elements not to crystallize. Unfortunately, the range of compositions that can be formed by these methods is very limited. The approaches presented herein overcome these limitations, thereby providing new methods and materials.

According to some embodiments, the technique of mechanical alloying may be used to extend the compositional variations of the iron-based amorphous structure. In one embodiment, a high energy milling technique uses high energy ball collisions with the constituent materials in hardened steel vials to generate localized deformation and melting of the material particles. Standard commercial ball milling equipment may be used, but application specific ball milling equipment may be developed for use with the inventive processes. After impact-generated localized heating occurs, and because the particles are in contact with the mass of the vial and the balls, the material is quickly quenched to the vial temperature. The vial must be kept cool, e.g., at a temperature sufficient to impart the appropriate CCR. This technique ensures that the materials do not have enough time to crystallize.

With continuing milling for an appropriate amount of time, the material may then be examined and verified that it is still amorphous. No crystallinity is developed during the mechanical alloying process described above.

According to some embodiments, a method of forming amorphous alloys may employ the use of high energetic deformation via the use of ball milling to introduce different compositions of molybdenum into an atomized iron-based amorphous alloy. In one approach, molybdenum was chosen as a starting addition into SAM2X5 powders; however, this technique can be extended to the addition of chromium, tungsten, and/or other metals and alloys of chromium, tungsten, molybdenum, and/or other metals.

With the addition of boron in high concentrations in some embodiments, or rather with high concentration of boron, the material will not only have better corrosion resistance, but it will also act as a good neutron absorber. To accomplish this, the elemental compositions of the alloy can be changed without changing the amorphous nature of the material. In one approach, boron powder may be mixed into a SAM1651 matrix with the goal of increasing the neutron absorption property and potential application in waste containers, such as those used in the Department of Energy's Yucca Mountain Project.

According to one embodiment, a method includes combining an amorphous iron-based alloy and a metal or metals to form a mixture. The one or more metal is selected from a group consisting of molybdenum, chromium, tungsten, boron, gadolinium, nickel phosphorous, yttrium, and alloys thereof. Also, the one or more metal is present in the mixture from about 5 at % to about 55 at %. The method also includes ball milling the mixture for a period of time that is long enough for an amorphous alloy of the iron-based alloy and the one or more metal to be formed. Such amount of time may be readily determined by one practicing the invention and periodically examining the material in the mill for the desired composition and amorphous state. In further approaches, the length of time in which the ball milling is performed may be longer than the time it takes to form the amorphous alloy.

In some embodiments, the iron-based alloy may be a product of atomization, e.g. SAM2X5 or SAM1651, etc. If the iron-based alloy is SAM1651, according to some approaches, the amorphous alloy of the iron-based alloy and the one or more metal may include boron, which may be present at greater than about 8 at %, or may be present at between about 10 at % and about 53 at %. Of course, boron may be present at higher and/or lower at % as well.

In other embodiments, the amorphous alloy of the iron-based alloy and the one or more metal may be at least about 80 at % amorphous, more preferably at least about 90 at % amorphous, even more preferably at least about 95% amorphous. The more amorphous the alloy of the iron-based alloy and the one or more metal is, the more useful it can be in some applications. Therefore, it is desirable to achieve a high level of amorphousness in the alloy of the iron-based alloy and the one or more metal.

In some approaches, an x-ray diffraction pattern of the amorphous alloy of the iron-based alloy and the one or more metal may show no sign of a crystalline form of the one or more metal. The x-ray diffraction pattern of the corrosion-resistant amorphous iron-based metal alloy may also show no sign of a crystalline form of other constituents. In further approaches, the amorphous alloy of the iron-based alloy and the one or more metal may comprise molybdenum which may be present at greater than about 9 at %; alternatively the molybdenum may be present at between about 12 at % and about 27 at %.

In yet another embodiment, an amorphous iron-based metal alloy comprises between about 10 at % and about 50 at % iron, between about 0 at % and about 25 at % of a metal selected from a group consisting of manganese, carbon, silicon, zirconium, and titanium. The amorphous iron-based metal alloy also comprises at least one of the following constituents: between about 15 at % and about 30 at % of at least one metal selected from a group consisting of molybdenum, tungsten, gadolinium, nickel phosphorous, yttrium, and alloys thereof, between about 20 at % and about 55 at % chromium, and between about 20 at % and about 55 at % boron.

In some embodiments, the at least one constituent may be molybdenum. The molybdenum may be present in the alloy at between about 15 at % and about 30 at %. Of course, other constituents may be used; and the constituents may be present in any atomic percent. Also, if the constituent is molybdenum, it may be present in atomic percentages of greater than 30 at % and 15 at %.

In more embodiments, the at least one constituent may be boron, chromium, or some other element.

A corrosion-resistant amorphous iron-based metal alloy, according to another embodiment, comprises between about 10 at % and about 50 at % iron, between about 15 at % and about 25 at % molybdenum, and between about 0 at % and about 25 at % of a metal selected from a group consisting of chromium, manganese, tungsten, carbon, boron, silicon, zirconium, titanium, and alloys thereof.

According to some approaches, the iron may be present at between about 40 at % and about 50 at %. Of course, the iron may also be present at greater or less atomic percent. In some further approaches, the molybdenum may be present at between about 12 at % and about 27 at %.

In more approaches, an x-ray diffraction pattern of the corrosion-resistant amorphous iron-based metal alloy may show no sign of a crystalline form of the molybdenum. The x-ray diffraction pattern of the corrosion-resistant amorphous iron-based metal alloy may also show no sign of a crystalline form of other constituents.

A radiation-shielding amorphous iron-based metal alloy comprises, in some embodiments, between about 10 at % and about 50 at % iron, between about 20 at % and about 55 at % boron, and between about 0 at % and about 25 at % of a metal selected from a group consisting of chromium, manganese, molybdenum, tungsten, carbon, silicon, zirconium, and titanium.

In further embodiments, the iron may be present at between about 25 at % and about 40 at %. Of course, the iron may be present in greater or less atomic percent in the radiation-shielding amorphous iron-based metal alloy. In addition, the boron may be present at between about 10 at % and about 53 at %. Of course, the boron may be present in greater or less atomic percent in the radiation-shielding amorphous iron-based metal alloy.

Experiments

The samples used for the experiments are listed in Table 1 in FIG. 5. For historical reasons, the SAM samples originated from SAM40. For example, SAM2X5 comprises 95 at % of SAM40 and 5 at % of Mo. Consequently, SAM2X10 comprises 90 at % of SAM40 and 10 at % of Mo and so forth. Table 1 also tabulates the atomic percentage of each element. To reduce the milling time, the starting matrix material of SAM2X5 and SAM1651 powders were prepared by the atomization technique. Two batches of molybdenum powder samples having a particle size of roughly 60 μm were used. The powder matrix samples of SAM2X5 and SAM1651 are amorphous as characterized by the x-ray diffraction technique.

Table 2 in FIG. 6 shows the atomic composition for SAM1651 additions and the amount (in grams) of boron that was added into 2 grams of the matrix sample. The milling process was carried out using the Spex800D Mil/Mixer with 2 hardened steel vials. Various numbers of 316 and 440 stainless steel balls of different sizes were used in the ball miller. During processing, the vials were kept cool using an in-house air system. Three batches of 1, 1½, and 2 grams of SAM2X5 matrix powder were used and the amount of molybdenum by weight to be added was calculated and is listed in Table 2 in FIG. 6. The batches, the number of balls used, and the milling times were closely monitored, recorded, and optimized to achieve an amorphous mixture, to reduce the milling time, and to increase the quantity of the resulting powders. Typically, twelve 5/16" balls (316SS and 440SS) with 2 grams of matrix powder and molybdenum or boron powders added. A milling time of about 16 hours resulted in total conversion of the mixture to a fully amorphous structure. The milling time can be shortened if the amount of matrix powders is reduced or the number of balls is changed. Typically, the powders are loaded into the vials in air. In situations where oxidation can easily occur, the loading should be carried out in a controlled inert atmosphere, such as in a glove box, clean room, etc. The resulting powders were then characterized using the XRD technique and crystalline metal oxides were not observed.

The X-ray diffraction experiments were carried out using the conventional Philips vertical goniometer utilizing Cu $K_\alpha$ radiation. An analyzing diffracted beam monochromator was used for energy discrimination. The scans were performed from about 20° to about 80° (2θ) with a 0.02° (2θ) step size at 4 second counting intervals per step. The powder material was loaded onto a special glass holder to avoid any scattering effects. The amorphous peak from the glass holder was located at about 20° to about 25° (2θ). In most cases, there were sufficient amounts of sample such that the scattering signal from the holder was negligible.

Experimental Results

The results of molybdenum additions to SAM2X5 are discussed below. After milling, the powder samples were carefully monitored and unloaded to avoid contamination. Typically, the resulting powder is black in color and very fine. SAM2X5 has a rounded particle shape which is typical of materials prepared by an atomization technique. The resultant milled powder is much finer and has irregular particle sizes of a few microns compared to the coarser atomized sample.

FIG. 1 shows the diffraction patterns of milled SAM2X10 powders at milling times of 0, 0.5, 5 and 7 hours. The curves are normalized for easy viewing. The starting physical mixture without milling is shown in the lowest pattern, indicating the presence of a crystalline component mixed with the amorphous SAM2X5. The three crystalline peaks can be indexed to cubic molybdenum. As it can be observed, the peak heights decrease as the milling time increases. The reduction in the peaks (and eventual disappearance) indicates that all of the components in the material, Mo and SAM2X5 are mixed at the atomic level and have become amorphous. It is interesting to note that the disappearance of Mo peaks is not totally due to the breakdown of the Mo crystals into nano-crystalline structures. This is because the Mo peaks diminish by losing intensity rather than by the increase in peak widths. The milling of SAM2X5 does not result in crystalline phases. Initial reduction of particle size can be observed by the peak broadening from the un-milled to the 0.5 hour milled sample.

Figure 2:
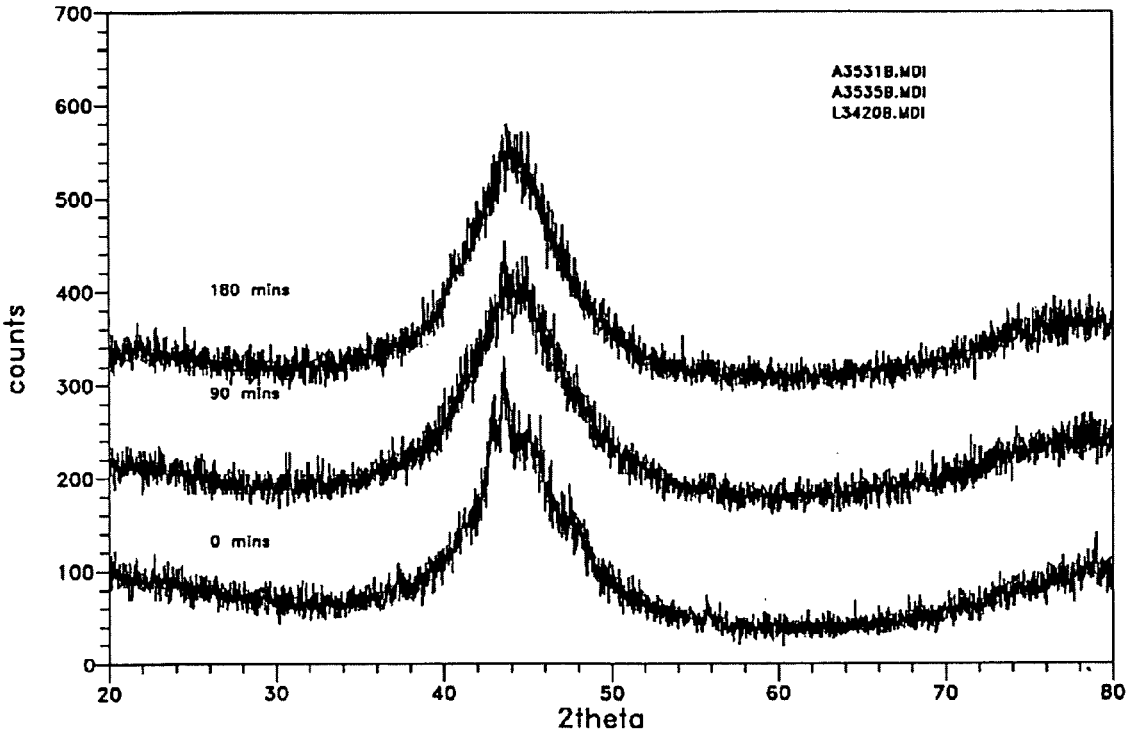
FIG. 2 shows an XRD spectra of milled SAM2X5 powder as a function of time.

To ensure that there are no changes in SAM2X5, neat matrix materials were also milled and the results are shown in FIG. 2, indicating an absence of any change in crystallinity. Therefore, milling the amorphous SAM2X5 did not generate any crystallinity; however, the particle size has been changed as the result of ball milling.

Figure 3:
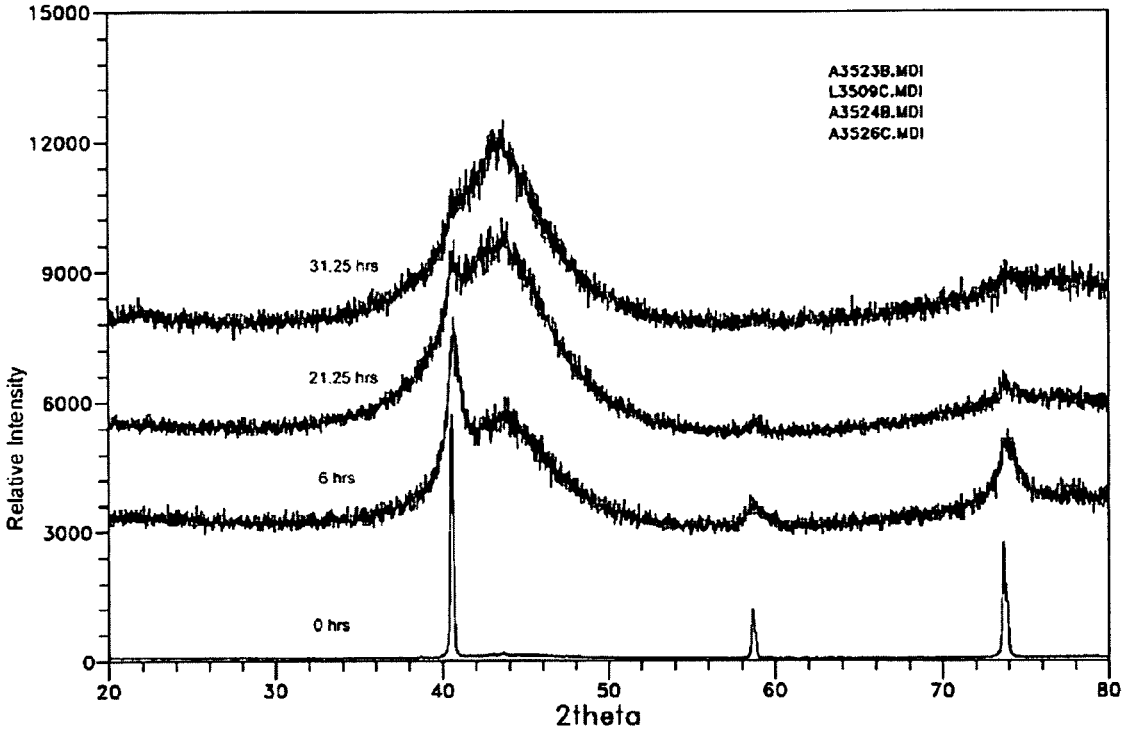
FIG. 3 shows an XRD spectra of SAM2X25 with increasing milling time.

Similar curves are obtained for SAM2X15 and SAM2X20 after some milling time. As listed in Table 1, SAM2X10, SAM2X15, SAM2X20 and SAM2X25 have 12, 17, 22, and 27 atomic % (at %) of molybdenum at concentration. FIG. 3 shows the resulting diffraction pattern for SAM2X25 which has as much as 27 at % of Mo. Clearly, it can be observed that with increasing milling time, the intensity of Mo peaks is reduced significantly. During the initial milling period, the results suggest that the crystalline molybdenum particles break down into nano-crystallites, as evidenced by the broadening of the Mo peak.

On continuing milling, these peaks diminish, suggesting that the crystalline Mo is incorporated into the SAM2X5 matrix, resulting in SAM2X25. Neat molybdenum powders were also processed using the mechanical alloying technique with the same processing parameters, that is, the same number of balls, amount of powder, and milling time. The result indicates the presence of crystalline Mo peaks, but the peaks are broader, suggesting that neat Mo cannot be made amorphous through the ball milling technique.

Figure 4:
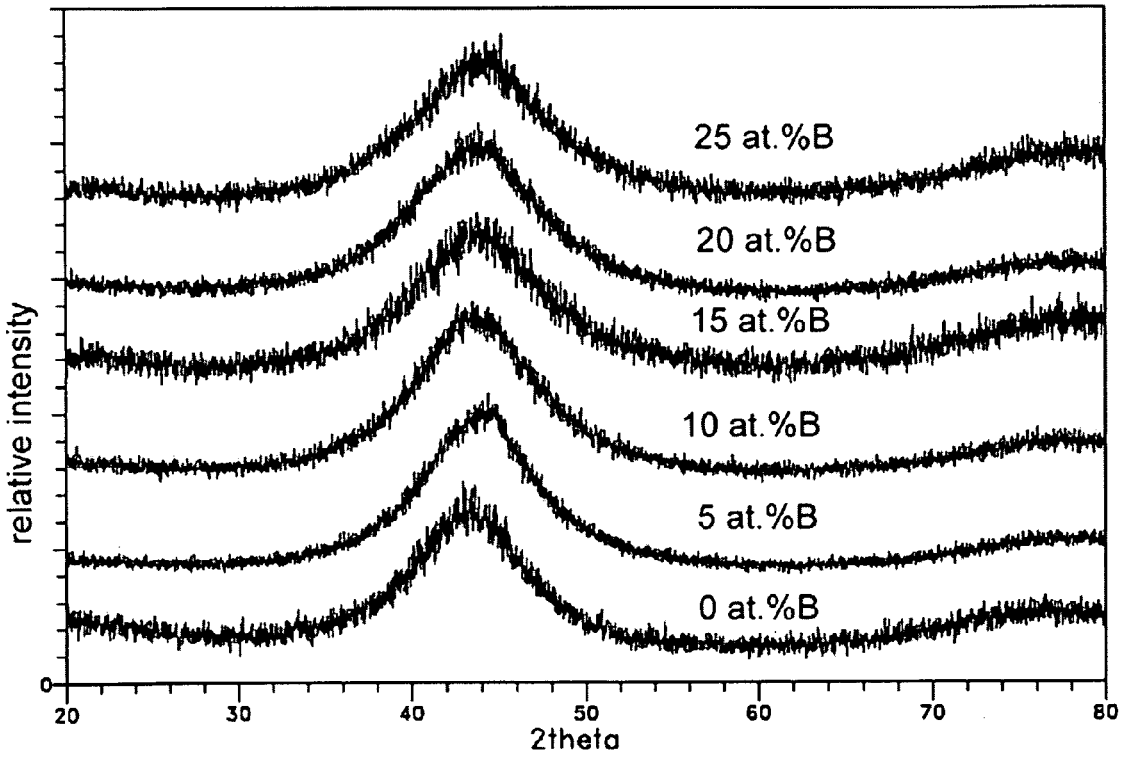
FIG. 4 shows XRD patterns of SAM1651 additions, with each curve representing the result of boron additions.

The addition of boron into SAM1651 is discussed below. The addition is determined using the calculations in Table 2. The concentrations for each percentile are calculated based on atomic percent. As calculated, the amount by weight that may be added into 2 grams of SAM is shown in the bottom row. Clearly, the addition of boron resulted in an amorphous structure even up to 25 at % of boron as shown in FIG. 4. Presently, the analysis cannot fully confirm that the boron atoms are incorporated into the SAM1651 matrix. This is because the X-ray scattering power of boron is significantly weaker than the other the elements used.

The technique of mechanical alloying allows the addition of other elements into the amorphous matrix of SAM2X5 without developing crystallinity. This is not possible by the atomization technique used in the prior art because of the tendency of some elements to form crystalline phases. Mechanical alloying is a particle deformation technique that uses high energy ball collisions. In fact, it has also been argued that there is even instantaneous local melting with rapid quenching caused by the cold high mass sample vial. Since the temperature of the vials is kept below the alloy glass transition temperature, the materials will not have sufficient energy to crystallize. In some embodiments, as much as 27 at % molybdenum may be added to SAM2X5 and the material may still remain amorphous. Furthermore, the concentration of SAM2X5 amorphous alloy can now be tuned to enhance specific properties, through the addition of Cr, W, alloys of Cr, alloys of W, alloys of Mo, etc.

The addition of boron to SAM1651 can be useful for controlling criticality and/or for providing radiation shielding in radioactive waste storage canisters. It appears that the incorporation of boron into SAM1651 yields amorphous alloys even up to the concentration of 50 at % boron. However, adding additional boron may be useful for some applications but may have negative impacts, on other alloy physical properties such as the corrosion resistance and hardness. Hence, this technique, in some embodiments, allows material synthesis with precise adjustment of the elemental compositions to fit a specific application while achieving an amorphous state.

The resultant powders from the mechanical alloying process may be nanometers in size. According to some embodiments, this powder property may enhance the forming of high density amorphous bulk materials during consolation. Intuitively, the material may be conveniently pressed and annealed at an appropriately chosen temperature above the glass transition temperature to avoid pores and void formation. In other embodiments, sintering heat treatment may also be used because the particles have been brought much closer together during the pressing process.

The embodiments described herein, and other embodiments not described but possible within the scope of the claims, may be useful for many different applications. For example, the amorphous powder may be fabricated to be used as a coating on components to enhance their corrosion resistance. Also, by adding neutron absorbing elements, the resulting materials may be used as a coating for nuclear storage baskets and/or waste containers, such as those used in the Yucca Mountain Project. There may be cost savings due to the use of the less expensive iron rather than a more expensive component. It is also possible that the material may be used to coat vessels and/or components used in saltwater or under harsh conditions, such as military applications, to prevent and/or reduce corrosion.

The ability to tailor the elemental composition of the amorphous iron based alloy is not necessarily limited to coatings. Using advanced powder compaction technology, bulk parts can be molded using these amorphous powders. Amorphous materials which lack discreet melting points tend to soften over a wide range of temperatures. Unlike conventional crystalline materials, this unique property enables the materials to be conveniently molded and still retain their amorphous structure.

Another property of amorphous materials is the formation of shear bands during impact. The shear band behavior allows for better absorption of high energy projectiles into bulk parts, such as armor plates. This is often described as a "self sharpening" phenomenon. The use of zirconium based amorphous metals with crystalline heavy metal wires has been described in U.S. Pat. No. 6,010,580, which is hereby incorporated by reference. Iron based alloys can also be used in a similar fashion. Consequently, armor plates made from amorphous materials can slow down the projectiles due to the shear band behavior. A successful employment of this material can replace the presently used depleted uranium armor plates, thus avoiding the toxicity issues associated with their production and disposal.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An amorphous iron-based alloy, comprising:
between about 10 atomic percent (at %) and about 50 at % iron;
from 0 at % to about 25 at % of a material selected from a group consisting of manganese, carbon, silicon, zirconium, and titanium; and
at least two of the following constituents:
between about 5 at % and about 30 at % of at least one material selected from a group consisting of molybdenum, tungsten, gadolinium, nickel phosphorous, yttrium, and alloys thereof;
between about 20 at % and about 55 at % chromium;
between about 30 at % and about 55 at % boron
wherein the at least two constituents comprise the molybdenum; and
wherein the molybdenum is present in the alloy at between about 15 at % and about 30 at %.

2. The amorphous iron-based alloy of claim 1, wherein the at least two constituents comprise the boron and the chromium.

3. The amorphous iron-based alloy of claim 1, wherein the at least two constituents comprise the chromium and the at least one material selected from the group consisting of tungsten, gadolinium, nickel, phosphorous, yttrium, and alloys thereof.

4. The amorphous iron-based alloy of claim 1, wherein the material selected from the group consisting of manganese, carbon, silicon, zirconium, and titanium is present at greater than 0 at %.

5. A corrosion-resistant amorphous iron-based alloy, comprising:
between about 10 atomic percent (at %) and about 50 at % iron;
between about 5 at % and about 25 at % molybdenum;
from about 15 at % to about 25 at % of a material selected from a group consisting of manganese, tungsten, and zirconium, and
wherein an x-ray diffraction pattern of the corrosion-resistant amorphous iron-based alloy shows no sign of a crystalline form.

6. The corrosion-resistant amorphous iron-based alloy of claim 5, wherein the iron is present at between about 40 at % and about 50 at %.

7. The corrosion-resistant amorphous iron-based alloy of claim 6, wherein the molybdenum is present at between about 17 at % and about 25 at %.

8. The corrosion-resistant amorphous iron-based alloy of claim 5, wherein the material is the zirconium,
and
wherein amorphous iron-based alloy further comprises boron present in an amount between about 30 at % and about 55 at %.

9. A radiation-shielding amorphous iron-based alloy, comprising:
between about 10 atomic percent (at %) and about 50 at % iron;
between about 30 at % and about 55 at % boron; and
from 0 at % to about 55 at % of a material selected from a group consisting of chromium, manganese, molybdenum, tungsten, carbon, silicon, zirconium, and titanium.

10. The radiation-shielding amorphous iron-based alloy of claim 9, wherein the iron is present at between about 25 at % and about 40 at %.

11. The radiation-shielding amorphous iron-based alloy of claim 10, wherein the boron is present at between about 30 at % and about 53 at %.

12. The radiation-shielding amorphous iron-based alloy of claim 9, wherein the material is the chromium, and
wherein the chromium is present in an amount from about 30 at % to about 55 at %.

13. The amorphous iron-based alloy of claim 9, wherein the material is the molybdenum, and
wherein the molybdenum is present in an amount from about 5 at % to about 25 at %.

14. A corrosion-resistant amorphous iron-based alloy, comprising:
between about 10 atomic percent (at %) and about 50 at % iron;
from 0 at % to about 25 at % of a material selected from a group consisting of manganese, carbon, silicon, zirconium, and titanium;

between about 15 at % and about 30 at % of at least one material selected from a group consisting of molybdenum, tungsten, gadolinium, nickel phosphorous, yttrium, and alloys thereof;

between about 20 at % and about 55 at % chromium; and between about 20 at % and about 55 at % boron, wherein an x-ray diffraction pattern of the corrosion-resistant amorphous iron-based alloy shows no sign of a crystalline form.

* * * * *